United States Patent [19]

Glinski et al.

[11] Patent Number: 4,773,965

[45] Date of Patent: Sep. 27, 1988

[54] STRONG AND CLEAN SULFITE PULP AND METHOD OF MAKING SAME

[75] Inventors: Allan J. Glinski; Paul G. Gilbert, both of Millinocket, Me.

[73] Assignee: Great Northern Paper, Millinocket, Me.

[21] Appl. No.: 77,839

[22] Filed: Jul. 27, 1987

Related U.S. Application Data

[63] Continuation-in-part of Ser. No. 831,387, Feb. 20, 1986.

[51] Int. Cl.[4] ..... D21C 9/00; D21C 9/08

[52] U.S. Cl. ..... 162/9; 162/24; 162/28; 162/55; 162/56; 162/57; 162/90

[58] Field of Search ..... 162/90, 24, 55, 28, 162/56, 57, 9

[56] References Cited

U.S. PATENT DOCUMENTS

| | | | |
|---|---|---|---|
| 2,000,562 | 5/1935 | Haglund | 162/90 X |
| 2,355,091 | 8/1944 | McDonald | 162/60 X |
| 3,597,310 | 8/1971 | Sumi et al. | 162/26 |

OTHER PUBLICATIONS

Page and Seth, "The Extensional Behavior of Commercial Mechanical Pulps", Pulp & Paper Canada, 80:8, pp. T235–T237, Aug. 1979.

Seth, Barbe and Page, "The Strength of Wet Webs: A New Approach", Tappi, 65:3, pp. 135–138, Mar. 1982.

Hill, Edwards and Beath, "Curlated Pulp–A New Approach to Pulp Processing", Tappi, 33:1, pp. 36–44, Jan. 1950.

*Primary Examiner*—Peter Chin
*Assistant Examiner*—Thi Dang
*Attorney, Agent, or Firm*—Pennie & Edmonds

[57] ABSTRACT

Sulfite pulp having increased tear, Scott bond, and stretch properties and above about 90% dirt reduction without bleaching. Methods for making such sulfite pulp by increasing the consistency of conventional sulfite pulp to above about 12 percent, shearing the increased consistency pulp under compressive forces to improve the tear and stretch properties of the pulp, refining the sheared pulp at pressures above atmospheric to remove dirt particles and achieve a desired freeness level, and removing fiber knots from the refined pulp.

18 Claims, No Drawings

STRONG AND CLEAN SULFITE PULP AND METHOD OF MAKING SAME

This is a continuation-in-part of application Ser. No. 831,387, filed Feb. 20, 1986.

TECHNICAL FIELD

This invention relates to methods for processing sulfite paper pulp in order to improve the strength and quality to levels approaching those of Kraft pulp.

BACKGROUND ART

In sulfite pulping processes, the cellulose fibers are liberated from the wood by dissolving lignin and some of the carbohydrate material. Since the principal constituents of the wood, i.e., cellulose, hemicellulose, and lignin, are chemically combined, the pulping process involves two principal types of concurrent reactions: the reaction of the lignin with the bisulfite, and the hydrolytic splitting of the cellulose-lignin complex. The mechanism of the removal of the sulfonated lignin has not yet been satisfactorily explained, perhaps because of incomplete knowledge of the structure of the lignin itself. Whatever the mechanism, the calcium salt of the sulfonated lignin (in the case of calcium-base liquors) is rendered soluble at the temperatures employed in the pulping process. The easily hydrolyzable hemicelluloses are dissolved at the same time. Fortunately, the major portion of the cellulose is comparatively stable under the processing conditions used.

An important requisite for wood to be used in the sulfite process is freedom from excessive amounts of resin. It is also important that any such resin in the wood be evenly distributed, for if it is localized at certain points, the wood at those places will remain hard and will cause shives in the pulp. Thus, the species which are most commonly used for sulfite pulp are spruce, balsam, hemlock, and the white or true firs. Though most hardwoods are readily reduced, their use has previously been limited due to their short fibers and the relatively low strength of the resulting pulps.

In sulfite processing, the liquor has less solvent power than the alkali used in the soda process, and any bark, decayed portions, or knots which go into the digester appear as dirt in the finished pulp. For pulp to be used as unbleached fiber, this also applies to the light-colored inner bark, since it changes color and shows as dark fibers in the pulp. For bleached pulp, this inner bark is harmless, since it bleaches quite readily.

Accordingly, unbleached sulfite pulp is not utilized in many applications for these reasons: Kraft pulp being preferred due to its higher strength and lower tendency to contain dark colored dirt particles.

Uniformity and cleanliness of chips are essential to clean pulp and obtain good yield. For best results, all chips cooked in the same charge are usually of one kind of wood and as nearly as possible of the same age and moisture content. This is because the moisture content of the chips can vary widely, depending upon the seasoning. Also, wet chips tend to pack more and cook more slowly than dry chips and may sometimes add to the difficulty in maintaining the acid strength during warm weather. Furthermore, some woods could not be cooked at all if charged dry, but would cook fairly easily if saturated with water by preliminary boiling and cooling before charging.

Sulfite pulp is generally processed in a digester as described in the following paragraphs. The general form of a sulfite digester is a vertical cylinder with conical or dome-shaped top and conical bottom, with the total length being about three times the diameter. Digesters of other forms are, of course, found in some of the older mills and horizontal digesters are sometimes used.

The method of making a cook depends on the type of process being employed. In one standard process, horizontal or vertical stationary digesters may be used, and all cooking is done by steam located in the bottom of the digester. The standard procedure is to fill the digester with chips and then steam gently for several hours with direct steam. After steaming, cold liquor is rapidly introduced. The temperature is then raised to about 110° C. as rapidly as possible, although this may require as much as 12 hours due to the size of the digester. The temperature in the digester is gradually raised to about 120° C., which is maintained throughout the cooking period. The sulfite liquor is then removed and the pulp is washed.

The liquor used in this process is about 3.5 to 4.5 percent total $SO_2$ with 0.9 to 1.24 percent combined. The actual cooking time varies in different mills, usually varying from 20 to 30 hours, depending on the temperature employed. The particular advantages of this process are relatively strong fiber and high yield because of the comparatively weak acid and the relatively low temperature of cooking.

An alternate cooking process, known as the quick-cook process, directly introduces steam into the digester. In this method, the digester is filled with wood chips, resulting in a rather loose packing. The settling of the chips during the first part of the cook suffices to cover them completely with liquor. Mechanical chips distributors, which effect a closer packing, are often used to increase the amount of charge and yield per digester. Charging the acid liquor into the bottom of the digester is the most generally satisfactory method of introduction. Steam is introduced through the bottom of the digester cone and, in many mills, through nozzles near the top of the cone directed upward to provide a better distribution.

In steaming a cook, it is important to slowly increase the steam pressure in order to avoid attaining a high temperature before the liquor has had time to penetrate the chips, because this causes the chip centers to become hard and red or brown in color. Generally, the digester should be heated rapidly to the critical temperature (e.g., about 110° C. for spruce and 120° C. for hemlock), the rate of temperature rise being limited by the time necessary for thorough penetration of the chips by the liquor.

The influence of increasing the concentration of combined $SO_2$ in the cooking liquor is mainly in the improvement of the yield and strength of the pulp. Concentrations are usually maintained at about 1.1 percent. Lowering the cooking temperatures tends to increase the time required for the same degree of purification but also tends to increase the yield and the uniformity of the pulp.

The treatment of the pulp after washing is largely a mechanical one, to remove dirt, knots, slivers, and uncooked or partly cooked chips, by means of screens or the like. Screening removes about 3 to 8 percent of the pulp produced. During these mechanical purification processes, the stock is diluted.

The chemical composition of unbleached sulfite pulp depends upon the degree of delignification or amount of cooking, the species of wood, and to some extent upon variations in the wood of any one species. As the cooking proceeds up to the point of exhaustion of the bisulfite, reductions occur in the yield, in the lignin content of the pulp, and in its chlorine consumption or bleach requirement. At the same time the alpha-cellulose content of the pulp is increased and its viscosity in cuprammonium solution is lowered. When strong pulp is desired for use in the unbleached condition, it is cooked less than for the more readily bleachable grades. In making pulp which is to be given further purification and bleaching treatment for the preparation of rayon and other cellulose derivatives, it is usually advantageous to accomplish as much purification as possible in the cooking treatment.

As noted previously, conventional sulfite pulp is washed to remove liquor, screened to remove long, wide fiber bundles and cleaned to remove short, choppy fiber bundles. This pulp is then deckered (removal of water) prior to storage or use in the mill. Despite these treatments, sulfite pulp contains many large pieces of dark colored bark particles and dark colored fiber particles which give the sheet a poor appearance. In addition to the dirt problem, sulfite pulp is known to have strength properties (especially tear) which are inferior to Kraft pulp.

Previously, those skilled in the art have pressed sulfite pulp in an attempt to improve the tear strength. They have also refined sulfite pulp atmospherically in an attempt to improve cleanliness with very minimal success. This refining step was usually carried out with the pulp at a low consistency and thus caused a substantial strength loss of the product with very little improvement in cleanliness. Atmospheric refining at high consistency resulted a modest improvement in cleanliness.

The inventors have now discovered improvements in the processing of sulfite pulp which render the dirt particles sufficiently small so that they are no longer objectionable from an aesthetic viewpoint, and which also enhance the tear and stretch properties of the pulp to levels approaching those of Kraft pulps, while maintaining breaking lengths above 5500 meters.

SUMMARY OF THE INVENTION

One aspect of the invention relates to a sulfite pulp having increased tear and stretch properties and above about 90% dirt reduction without bleaching. This pulp product can be used in place of Kraft pulp in a variety of paper products.

The invention also relates to a method for improving the tear and stretch properties, as well as the appearance and quality, of conventional, unbleached low yield sulfite pulp to levels approaching those of Kraft pulps. This method includes the steps of increasing the consistency of the pulp to above at least about 12 percent, shearing the increased consistency pulp under compressive forces to improve the tear and stretch properties of the pulp, refining the sheared pulp at a pressure above atmospheric to remove dirt particles and achieve a desired freeness level, and removing fiber knits from the refined pulp to obtain the desired sulfite pulp product. Also, the invention includes the sulfite pulps made by the previously described method.

DETAILED DESCRIPTION OF THE PREFERRED EMBODIMENTS

Applicants have now discovered a sequence of processing conditions for conventional unbleached sulfite pulp which results in an improvement in both the cleanliness and strength of the material. By low yield sulfite pulp, we mean a pulp produced by the acid sulfite or bisulfite process and having a yield of 60% or less. Most preferably, yields of between 45 and 50% produce optimum results. Although low yield sulfite pulp is the preferred starting material for this invention, improvements have been observed with other low yield pulps. For example, the tear and stretch properties of Kraft pulp can be increased and its dirt content decreased by subjecting those pulps to the process of this invention. This improvement is achieved by initially increasing the consistency of the pulp to above about 12 percent. This high consistency pulp is then pressed and twisted in a plug screw feeder. The compressive and shear action of the feeder increases the tear and stretch properties of the pulp, but does little to improve the pulp cleanliness. Therefore, after pressing, the pulp is refined in a steam pressurized disc refiner at pressures preferably above atmospheric to remove dirt particles and achieve the desired freeness level. The refining action under pressure reduces the dirt particles to a size where they are no longer visually objectionable. The term freeness is a measure of how well the pulp will dewater. Energy consumptions ranging from 5 to 20 hpd/ton will provide pulps with a freeness level between about 650 and 500. Thereafter, the pulp is diluted to a consistency of between about 3–15 percent and fiber bundles are removed in a manner similar to that for removing latency. Finally, the improved sulfite pulps are recovered.

It was believed that a substantial increase in strength could be achieved by pressing alone and, despite that the refining step would cause some strength reduction, a clean pulp would be obtained that has sufficient strength for the intended applications. However, it was surprisingly found that both cleanliness and strength were substantially improved. Thus, the combination of compressive shearing high consistency pulp with pressurized refining provides substantial improvements in the properties of the sulfite pulp of the invention.

Initially, unbleached lower yield sulfite pulp is obtained by any of the conventional processes. Next, the pulp is washed, screened, cleaned, and deckered by conventional procedures. The consistency of the pulp, usually on the order of about 3–5 percent, is then increased to above at least above 12 percent. Below about 12 percent, the slurry is essentially a liquid with the resulting cake being a semi-fluid. Thus, the fibers cannot interact properly to achieve the desired results in further processing operations. For example, no increase in tear strength is observed for pulps processed according to the method of invention when the consistency is increased to less than 12 percent. Also, for optimum performance in the continuous processing of the pulp, it is preferred to initially increase the consistency to above about 25 percent, since it is difficult to effectively process pulp of a lower consistency in certain types of equipment.

The increased consistency pulp is then subjected to a shearing action under compressive force. A preferred way to accomplish this is by passing the high consistency pulp through a plug screwfeeder. A particularly useful unit for achieving the desired result is a Sprout- Waldron 12" diameter plug screw feeder model no. C3938-050. This unit has a screw which extends only partially through a cylinder. In operation, the rotation of the screw imparts a shearing action under compressive force on the pulp. As more and more pulp passes along the screw, a compressed plug of pulp forms in the discharge portion of the cylinder.

The discharge end of the plug screwfeeder is connected to a preheating vessel which is capable of being pressurized preferably by steam. The pressure in the preheating vessel prevents the pulp from entering this vessel until after the pressure of the pulp plug exceeds the pressure in the vessel. Since this plug forms the pressure seal of the preheating vessel, it is advisable for the screwfeeder to be equipped with a blowback damper to prevent the pressure in the vessel from causing the pulp plug to be forced back against the flights of the screw in the event the operation of the screwfeeder is suspended.

It is this shearing and compressive action which produces a substantial increase in the tear and stretch properties of the pulp while maintaining breaking lengths above 5500 meters. These increases are evident upon a comparison of the properties of conventional sulfite pulp with pulp produced by this invention. This comparison appears in Table I below:

TABLE I

| Property | Sulfite Pulp Properties conventional sulfite pulp | applicants' pulp A | applicants' pulp B |
|---|---|---|---|
| freeness (ml) | 670 | 630 | 570 |
| % debris level (6-cut Somerville) | .24 | .01 | <.01 |
| shive count (Von Alfthan) | 90 | 31 | 28 |
| TAPPI dirt count (visual) | 207 | 14 | 5 |
| tear factor | 88 | 149 | 133 |
| breaking length (m) | 7000 | 5700 | 6800 |
| Scott bond | 85 | 223 | >250 |
| % stretch | 3.2 | 5.2 | 5.5 |
| refining power (hpd/ton) | N/A | 6.5 | 12 |

Only low yield pulps will produce tear enhancements when passed at high consisting through a plug screwfeeder. No tear enhancement occurs when pulps of greater than 60% yield are passed through the compressive and twisting forces of the plug screwfeeder. This improvement has been found with either low yield sulfite pulps or low yield Kraft pulps, although sulfite pulps are preferred.

The tear and stretch enhancements obtained with plug screwfeeder treatment of the present invention are much greater than the results obtained in the past because of three changes: 1. higher pulp consistencies; 2. greater compressive forces in the pulp screwfeeder (the plug screwfeeder used in the testing had a 5:1 compression ratio); 3. The high consistency pulp is subjected to steam pressures of between about 10 and 60 psig (corresponding to relatively high temperatures of between about 240° and 308° F. or 116° or 153° C.) for about 20 seconds to several minutes after the fibers have been twisted and kinked to stress relieve the fibers.

When the fibers are twisted and kinked by mechanical means, stresses are introduced in the fibers. If this pulp were to be agitated at low consistency immediately after stresses were imposed, much of the curl and stretch of the fibers would be lost. However, if heat treatment follows the kinking treatment while the pulp is at high consistency and fibers are still trapped in their very stressful, twisted positions, the stresses will "relax" and accept their curled and twisted states as being their "natural" positions. Subsequent low consistency agitation at lower temperatures removes fiber knits, but the curl and twist of individual fibers are still set. These properties in return produce the permanent tear and stretch enhancements observed in the pulps processed by the methods of the present invention.

Pulp from the preheating vessel then enters the refiner. The refining step should be preferably conducted under pressure, but may be carried out at atmospheric pressure, if desired. Thus, a preferred refiner is a pressurized disc refiner. In this equipment, there are two circular discs at least one of which rotates. These discs are spaced at a predetermined distance which is adjustable by the operator. The pulp is beaten or refined by passing between these discs. At lower pressures, the distance between the discs must be relatively large to allow for passage of the pulp. At higher pressures, however, the pulp passes more freely between the discs and, as a result, smaller disc spacings can be used.

With the inception of such pressurized refiners, it is now possible to refine at higher temperatures and pressures. This enables the pulp to pass more easily between the disks of the disk refiner. Thus, at such higher pressures and temperatures, the spacing or distance between the disks can be reduced. This, in turn, causes dirt to be more easily broken down to very small, inconspicuous particles. The combination of pressing followed by high consistency pressurized refining allows the invention to achieve the enhancement of the strength of the pulp with the minimizing of the size of the dirt or impurity particles. Furthermore, sulfite pulp made from any type of wood can be used, since dirt particles are removed by this invention in the pressurized refining step.

The degree of refining produces a particular freeness for the pulp. While, for certain applications, a very low freeness may be used, a common range of freeness is between about 550 and 670. Unrefined pulp generally has a freeness of about 670. For newsprint, for example, a freeness of about 630 is desired, while certain coated grades of paper generally require a freeness of about 570 or lower. Even lower freeness levels can be achieved, but the power requirements to obtain such lower levels are substantially greater.

When refining under pressure, the distance between the discs can be decreased to achieve the same level of freeness as for atmospheric refining. To obtain a freeness of about 600, the disc distance for pressurized refining is about $\frac{1}{3}$ that required for atmospheric refining. The pressurized refining step substantially improves the cleanliness of the pulp without the need for bleaching. Dirt particles, such as bark specks, shives and other undesireable particles, are substantially eliminated when refining high consistency pulp under pressure.

The pressure for such high pressure refining is not critical to the invention. Any pressure above atmospheric can be used, depending upon the upper limit of the specific equipment utilized. Improvements in cleanliness have been observed at steam pressures as low as 10 psig. A range of about 15–17 psig is suitable for continuous production, but optimum results appear to be attained at a pressure of 30 to 40 psig, utilizing a Sprout-Waldron model no. 36-ICP pressurized disc refiner.

It should be emphasized that it is the pressure refining of high consistency pulp which achieves the desired dirt reduction. For example, at a consistency of 3 percent, pulp which is post-refined to a freeness level of about 600 shows essentially no dirt reduction at all, whereas 15 percent consistency pulp refined under pressure shows a substantial reduction of such dirt particles. While refining is known to reduce the tear strength of the pulp, such reductions were found to be minimal in the processing of high consistency pulp. Along with dirt reduction, the pulp gained in tensile strength when processed in this manner.

Finally the pulp is diluted to a consistency of about 3 to 15 percent and then treated to remove fiber knits. In one embodiment, the pulp is blown from the refiner to a cyclone where dilution water is added. The fiber knits in the pulp are then removed by agitation in an open vessel at 160° F. for 20 minutes. Alternately, the pulp can be passed through a pump to achieve similar results. Finally, the improved pulps are recovered using conventional techniques.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A method for improving the appearance of a low yield sulfite pulp which comprises:

increasing the consistency of low yield sulfite pulp to above at least about 12 percent;

shearing the increased consistency pulp under a compressive force to twist and kink a sufficient proportion of the fibers of the pulp to improve the tear and stretch properties of the pulp;

refining the sheared pulp in a steam pressurized disc-refiner at a pressure above atmospheric pressure to remove dirt particles and achieve a desired freeness level; and diluting the refined pulp and agitating the diluted pulp to remove fiber knits, thereby obtaining sulfite pulp having improved tear and stretch properties and appearance.

2. The method of claim 1 wherein the consistency of the pulp is increased to above about 25 percent.

3. The method of claim 1 wherein the consistency is increased by pressing the pulp between rollers.

4. The method of claim 1 wherein the pulp is sheared by a twisting and squeezing operation.

5. The method of claim 4 wherein the twisting and squeezing operation is carried out by plug screwfeeder means.

6. The method of claim 1 wherein fiber knits are removed by agitating the diluted pulp in an open vessel with agitation means, or by passing the pulp through pumping means.

7. A method for improving the appearance of low yield sulfite pulp which comprises:

increasing the consistency of low yield sulfite pulp to above about 25 percent;

subjecting the increased consistency pulp to a compressive shear force to twist and kink a sufficient proportion of the fibers of the pulp by passing the increased consistency pulp through plug screwfeeder means to improve the tear and stretch properties of the pulp;

refining the resulting pulp in a steam pressurized disc-refiner means to remove dirt particles and achieve a desired freeness level; and diluting the refined pulp and agitating the diluted pulp to remove the fiber knits, thereby obtaining sulfite pulp having improved properties.

8. A method for improving the tear and stretch properties and appearance of unbleached low yield sulfite pulp which comprises:

increasing the consistency of unbleached low yield sulfite pulp from about 3 to 5 percent to above at least about 12 percent;

passing the increased consistency pulp through plug screwfeeder means to shear the pulp under a compressive force to twist and kink a sufficient proportion of the fibers of the pulp to improve the tear and stretch properties of the pulp;

heating the sheared pulp for a sufficient time to relieve stresses in and set the twisted and kinked fibers;

refining the stress relieved pulp in a steam pressurized disc refiner means at a pressure above atmospheric pressure to remove dirt particles and achieve a desired freeness level; and diluting the refined pulp and agitating the diluted pulp to remove fiber knits, thereby obtaining unbleached low yield sulfite pulp having improved tear and stretch properties and appearance.

9. The method of claim 8 wherein the consistency of the pulp is increased to above about 25 percent.

10. The method of claim 8 wherein fiber knits are removed by diluting the refined pulp to a low consistency and agitating the diluted pulp at a sufficient temperature and for sufficient time to break-up such fiber knits.

11. The method of claim 10 wherein fiber knits are removed by agitating the diluted pulp in an open vessel with agitation means, or by passing the pulp through pumping means.

12. The method of claim 8 wherein the refining step is carried out at a steam pressure of at least 10 psig.

13. The method of claim 8 wherein the sheared pulp is heated to a temperature range of between about 240° and 308° F. for between about 20 seconds to several minutes to stress relieve the twisted and kinked fibers.

14. The method of claim 1 wherein the refining step is carried out at a steam pressure of at least 10 psig.

15. The method of claim 1 which further comprises heating the sheared pulp to a temperature range of between about 240° and 308° F. for between about 20 seconds to several minutes to stress relieve the twisted and kinked fibers.

16. The method of claim 7 wherein the refining step is carried out at a steam pressure of at least 10 psig.

17. The method of claim 10 which further comprises heating the sheared pulp to a temperature range of between about 240° and 308° F. for between about 20 seconds to several minutes to stress relieve the twisted and kinked fibers.

18. A method for improving the appearance of a low yield paper pulp which comprises:

increasing the consistency of a low yield paper pulp to above at least about 12 percent;

shearing the increased consistency pulp under a compressive force to twist and kink a sufficient proportion of the fibers of the pulp to improve the tear and stretch properties of the pulp;

heating the sheared pulp for a sufficient time to relieve stresses in and set the twisted and kinked fibers;

refining the stress-relieved pulp in a pressurized disc refiner at a pressure above atmospheric pressure to remove dirt particles and achieve a desired freeness level; and diluting the refined pulp and agitating the diluted pulp to remove fiber knits, thereby obtaining a low yield pulp having improved tear and stretch properties and appearance.

* * * * *